US007004255B2

(12) United States Patent
Boney

(10) Patent No.: US 7,004,255 B2
(45) Date of Patent: Feb. 28, 2006

(54) FRACTURE PLUGGING

(75) Inventor: Curtis Boney, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 10/250,117

(22) Filed: Jun. 4, 2003

(65) Prior Publication Data

US 2005/0000690 A1 Jan. 6, 2005

(51) Int. Cl.
*E21B 43/267* (2006.01)

(52) U.S. Cl. ..... 166/280.2; 166/276; 166/278; 166/308.3

(58) Field of Classification Search ..... 166/276, 166/278, 280.1, 280.2, 281, 285, 293, 308.1, 166/308.2, 308.3
See application file for complete search history.

(56) References Cited

U.S. PATENT DOCUMENTS 5,325,921 A * 7/1994 Johnson et al. ..... 166/280.1
5,332,037 A * 7/1994 Schmidt et al. ..... 166/276
5,518,996 A 5/1996 Maroy et al. ..... 507/100

* cited by examiner

*Primary Examiner*—Zakiya Walker
(74) *Attorney, Agent, or Firm*—Thomas O. Mitchell; Tim Curington; Robin Nava

(57) ABSTRACT

Compositions and methods are given for plugging of natural or artificially-created fractures in subterranean formations to reduce the flow of fluids. The compositions are mixtures of primarily inert particles of different sizes that leave a minimal flow path for fluids when the particles are packed in the fracture. If the fracture can close on the particles, the particles need not fill the width of the fracture before closure to cause plugging.

25 Claims, 1 Drawing Sheet

FRACTURE PLUGGING

BACKGROUND OF INVENTION

The invention relates to subterranean wells for the injection, storage, or production of fluids. More particularly it relates to plugging fractures in formations in such wells.

Fractures in reservoirs normally have the highest flow capacity of any portion of the reservoir formation. These fractures in the formation may be natural or hydraulically generated. In a natural fault in the rock structure, the high flow capacity results either from the same factors as for natural fractures or from the fracture being open for example due to natural asperities or because the rock is hard and the closure stress is low. In artificially created fractures, such as those created by hydraulic fracturing or acid fracturing, the high flow capacity results from the fracture being either propped with a very permeable bed of material or etched along the fracture face with acid or other material that has dissolved part of the formation.

Fractures of interest in this field are typically connected to the formation and to the wellbore. Large volumes of fluids will travel through fractures due to their high flow capacity. This allows wells to have high fluid rates for production or injection. Normally, this is desirable.

However, in the course of creating or using an oil or gas well, it is often desirable to plug or partially plug a fracture in the rock formations, thereby reducing its flow capacity. Typically the reasons for plugging these fractures are that a) they are producing unwanted water or gas, b) there is non-uniformity of injected fluid (such as water or $CO_2$) in an enhanced recovery flood, or c) expensive materials (such as hydraulic fracturing fluids during fracturing) are being injected into non-producing areas of the formation. This latter case can be particularly deleterious if it results in undesirable fracture growth because at best it wastes manpower, hydraulic horsepower, and materials, to produce a fracture where it is not needed, and at worst it results in the growth of a fracture into a region from which undesirable fluids, such as water, are produced.

Past techniques for plugging fractures have included cement systems, hydrating clays, and both crosslinked and non-crosslinked polymer solutions. The disadvantages of cement systems are the requirements for expensive materials and well work, and the systems" inability to travel down the fracture without bridging prematurely. The hydrating clays require the complexity and cost of pumping oil-based systems plus expensive well work. The hydrating clays also have the same problem as the cement with regard to placement: needing to avoid premature bridging; they also have the requirement of needing to hydrate fully along the fracture. The polymer systems often fail due to their lack of flow resistance in very permeable fractures and because the materials are expensive considering the large volumes that are required. There is a need for an inexpensive, reliable, easily placed, effective well plugging material and methods for use during well completion or remediation, especially stimulation, and during fluids production.

SUMMARY OF INVENTION

Embodiments of the invention include a method of plugging a fracture in a formation or reducing the fluid flow in a fracture in a formation by placing into the fracture a mixture of two or three different size ranges (selected from coarse, medium, and fine, provided that coarse is always included) of particulate material. The sizes, and ratio of the amounts of the particles of different sizes, are chosen to minimize the void space in the bed of particles when the particles are compacted; preferably the void volume is less than about 17%. The amount of particles is at a minimum sufficient to fill the region of the fracture to be plugged with at least a monolayer (with respect to one wall of the fracture) of the coarsest particles in the mixture of particulate material. The coarse particles have diameters from about 0.20 mm to about 2.35 mm; the medium particles have diameters from about 0.10 mm to about 0.20 mm; the fine particles have diameters less than about 0.10 mm. The coarse particles have mean diameters from about 5 times to about 12 times the mean diameters of the medium particles, preferably about 10 times; the medium particles have mean diameters from about 5 times to about 12 times the mean diameters of the fine particles. The particles are preferably inert. The particles are placed into the fracture by pumping a slurry in a carrier fluid that may be viscosified. This introduction of the particles may be done while the fracture is being formed, in which case the entire fracture need not be filled provided that at least a monolayer of the coarsest particles is introduced, after which the fracture may close on the particles, or the particles may be introduced to fill natural fractures or artificial fractures after they have been formed. In other embodiments, the slurry may also contain a malleable material such as fibers and/or may contain a component that leaks off into the formation and impedes fluid flow into the fracture and/or may contain a wall-building material.

In one embodiment, when a fracture being created may be expected to grow into a region above the region in the formation in which the fracture is intended to be formed, the slurry of the particle mixture injected is injected before the proppant slurry used to form the fracture is injected, and the slurry of the particle mixture is lighter than the proppant slurry. A pack of the particle mixture is then formed in the upper portion of the fracture and plugs that portion or reduces the flow in that portion. In an analogous manner, if the fracture is expected to grow below the desired region, a heavier slurry of particulate material is injected before the proppant slurry.

In another embodiment, when a fracture being created may be expected to grow into a region above or below the region in the formation in which the fracture is intended to be formed, tubing is lowered into the wellbore to above or below the region where the fracture is desired. The particle mixture slurry is then injected into the tubing while the proppant mixture is injected through the annulus between the tubing and the wellbore. Thus, as the fracture grows, plugging material is injected into the region where a fracture through which fluid can flow readily is not desired while a conventional proppant slurry is placed in the region of the fracture where high fluid conductivity is desired. The tubing may be moved during this process to ensure that the entire undesirable portion of the fracture is plugged.

DETAILED DESCRIPTION

Figure 1:
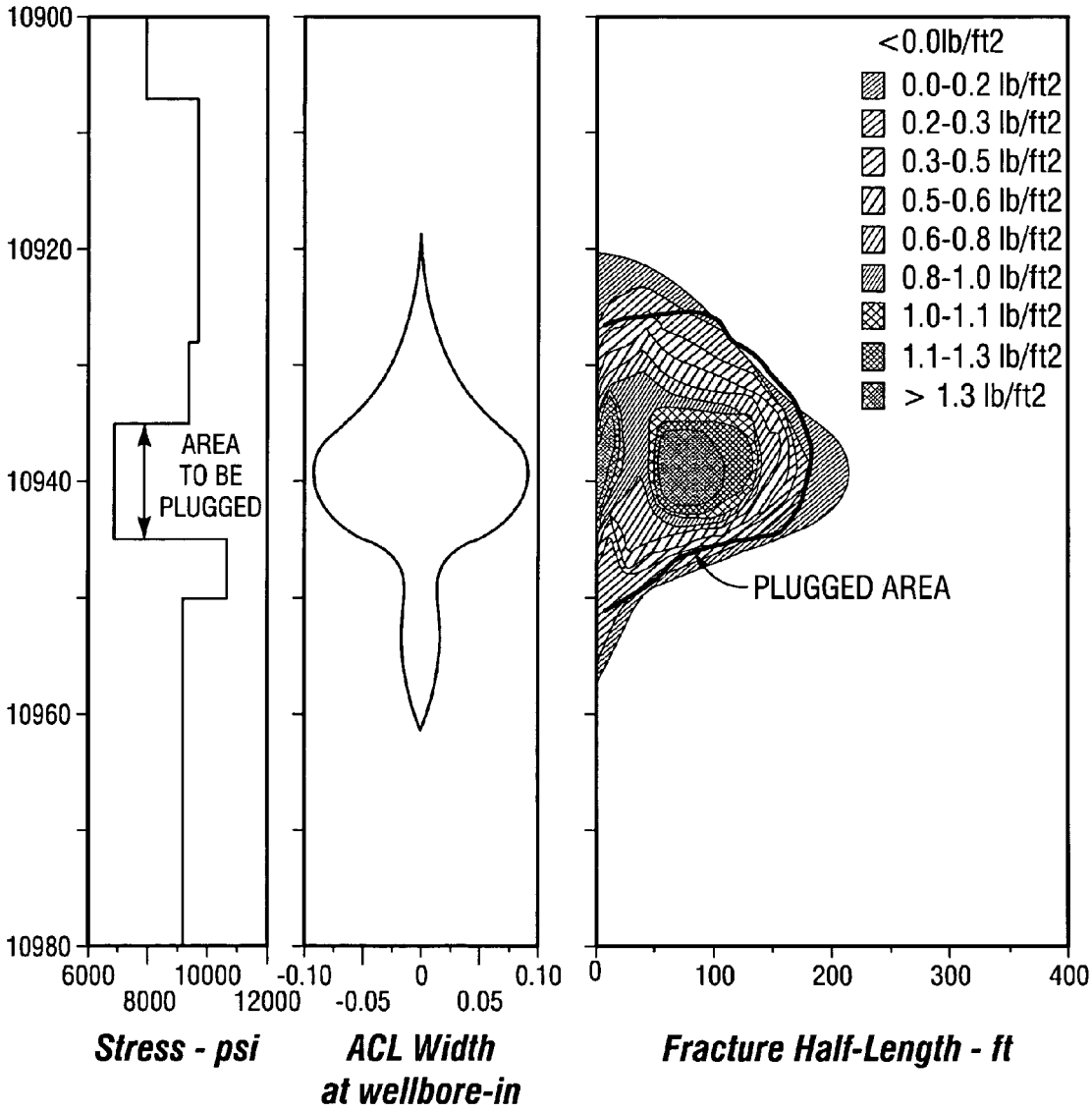
FIG. 1 shows a predicted plugged fracture location and size, and the calculated plugging sand distribution in the fracture.

Normally, when it is desirable to produce the maximum flow rate along a fracture, the fracture will be created in such a way as to have the greatest permeability and width, to maximize flow and minimize pressure drop along the fracture. This is typically achieved by placing in the fracture a hard material (called a proppant) that is (as nearly as practicable) round, large and uniform in particle size. This gives the greatest porosity (pore volume) and pore size (pore diameter). High porosity and large pores make the proppant bed highly permeable. The porosity of a propped fracture will be in the range of 30–36% of the volume of the fracture.

I have found that it is instead possible to fill a fracture with an inert particulate material pack that has a very low permeability and will block off liquid or gas flow along the fracture. Particles can be placed in a fracture to plug or partially plug the fracture; the pack will, by design, have very different properties from the collection of particles typically placed in a fracture to maximize pore volume and pore diameter. The particles sizes in embodiments of the present invention are optimized to give the lowest porosity with the smallest and fewest pores. This is done by selection of the proper materials and sizes for the particles placed in the fracture to be plugged. Examples of the uses of size ranges to affect filling are given in U.S. Pat. No. 5,518,996.

The plugging material is made up preferably of 2 or 3 basic sizes of materials; when there are three they will be called "coarse", "medium" and "fine". The coarse particle material will be approximately 0.20 mm to approximately 2.35 mm in diameter. This is large enough to keep the material from flowing back out of the fracture and small enough to be placed, for example by methods and with equipment typically used in hydraulic fracturing. The next (or sometimes optionally only) smaller material ("medium" material) will normally be from about 0.10 mm to about 0.20 mm in diameter. The key factor is that the design will allow these smaller particles to be large enough to bridge in the pore spaces formed by the larger material but not small enough to flow through the pore throats in the pack of larger particles. If this does not reduce the pore volume (void volume) of the fracture down to 17% or less of the volume of the fracture, then a third material, even smaller than the second material, may be added to the mixture to reduce the porosity further. The third material will have the same size requirements relative to the second material as the second material does to the first. The optimal goal is reduce the pack porosity to 17% or less. The third material ("fine" material), if it is present, will have a maximum diameter less than about 0.10 mm.

It is well known that a region filled with regularly arranged spheres of equal size will have a void volume of about 36%. Furthermore, if a second set of equal-sized spheres that are about one tenth the size of the first set are included, the smaller spheres will tend to reside in the voids between the larger spheres, and the resulting void volume will be about 23%. Finally, if a third set of equal-sized spheres that are about one tenth the size of the second set are included, the final void volume will be about 15%. Clearly, a mixture of about 60 volume % of the coarse spheres, 30 volume % of the medium spheres, and 10 volume % of the fine spheres will be most suitable. These guidelines are approximately correct for the real-world situation in which the particles are not perfect spheres, are not uniform in size, and are not perfectly packed. A situation in which the void volume is minimized is said to have maximum compaction.

Of coarse, instead of the "coarse" and "medium" example given above, if two sizes are used instead of three, they could be "medium" and "fine", or "coarse" and"fine". Although the ranges of the definitions of "coarse", "medium" and"fine" have been given as contiguous, it is preferred that the actual sizes used not be contiguous. For example, although coarse may be from about 0.20 mm to approximately 2.35 mm and "medium" may be from about 0.10 mm to about 0.20 mm in diameter, actual sizes used in a treatment might be about 1 to 2 mm and about 0.1 to 0.2 mm respectively.

It should be understood that the goal in many embodiments of the invention is not necessarily to leave the minimal possible void volume in a particle pack in a fracture (and thus to stop completely all fluid flow through a fracture), but only to reduce the void volume substantially in order to reduce the ability of fluids to flow through the particle pack in the fracture. Thus, in some cases, the choices of the number of particle size ranges, the particle size distributions within each range of particles, the differences between the sizes of the ranges, the amounts of the ranges, and other factors may be made on the basis of economics, expedience, or simplicity, rather than on the need for optimal filling. This is significantly different from such operations as cementing, where any failure to fill a void completely could be disastrous. For example, the average particle in each size range of particles in embodiments of the present invention need only be approximately 5–12 times the size of the next smallest.

When suspended in a suitable carrier fluid, the particle mixture is called the "filling slurry". The carrier fluid will be more fully described below. However, the typical concentration of a slurry of particles used in embodiments of this invention is much less than the typical concentration of particles in a cement slurry. Cements are very concentrated slurries, typically having total particle concentrations of about 50 volume % or more. The slurries of embodiments of the present invention are much more dilute, typically having total particle concentrations of from about 0.1 kg/L to about 0.75 kg/L, preferably about 0.35 kg/L. In embodiments of the invention in which the fracture closes on the particles, the particles will become concentrated in the slurry as fluid leaks off, and the particle concentration in the fracture, after the fracture has closed until the particle pack is as fully compacted as possible, will be comparable to that in a set cement.

To prevent particle separation and uneven packing during mixing and injection of the particles, the densities of the particles should be within about 20% of one another other. Particles are mixed and pumped using equipment and procedures commonly used in the oilfield for cementing, hydraulic fracturing, drilling, and acidizing. Particles are pre-mixed or mixed on site. They are generally mixed and pumped as a slurry in a carrier fluid such as water, oil, viscosified water, viscosified oil, and slick water (water containing a small amount of polymer that serves primarily as a friction reducer rather than primarily as a viscosifier). Unless the particles have a very low density, and/or the carrier fluid has a very high density, and/or the pump rate is very high, the carrier fluid will normally be viscosified in order to help suspend the particles. Any method of viscosifying the carrier fluid may be used. Water is preferably viscosified with a polymer, that may be crosslinked or not. The polymer, especially if it is crosslinked, may remain and be concentrated in the fracture after the treatment and help impede fluid flow. In fracturing, polymers are usually crosslinked to increase viscosity with a minimum of polymer. In embodiments of the present invention, more polymer may be better than less, unless cost prevents it, and crosslinking adds cost and complexity, so uncrosslinked fluids can be desirable. (However, more viscous fluids tend to widen fractures, which may be undesirable.) In fracturing, it is desirable for the polymer to decompose after the treatment, so the least thermally stable polymer that will survive long enough to place the proppant is often chosen. In embodiments of the present invention, stable polymers, such as polyacrylamides, substituted polyacrylamides, and others may be advantageous. The choice of polymer, its concentration, and crosslinker, if any, is made by balancing these factors for effectiveness, taking cost, expediency, and simplicity into account.

The preferred material is sand of properly selected sizes because it is inexpensive. However, other materials such as barite, fly ash, fumed silica, other crystalline or amorphous silicas, talc, mica, ceramic beads, carbonates, or taconite may be used. Any materials that will retain their particle size and shape during and after placement and that will not cause the placement fluid to fail are acceptable. However, they should not interfere with the viscosifying chemicals if the carrier fluid is viscosified and they should not be soluble in the carrier fluid or in fluids whose flow they are intended to impede or prevent. If cost permits, an enhancement is to use a malleable material as some or all, preferably all, of the coarse particles. The malleable product further reduces the porosity when the fracture closes. Examples of these materials are walnut shells, aluminum pellets, and polymer beads. Although the particles of the plugging material are normally inert, they may also interact with one another chemically. For example, they may be resin-coated so that they stick together when heated. The particles may also include compositions that would react to form a cement, although that is not necessary.

Placement of the plugging material is similar to the placement of proppant in hydraulic fracturing. The plugging material is suspended in a carrier fluid to form what will be called a "filling slurry". If a fracture is being created and plugged at the same time, a "Property3D" (P3D) hydraulic fracture simulator is used to design the fracture job and simulate the final fracture geometry and filling material placement. (If an existing fracture is being plugged, a simulator is not normally used.)Examples of such a P3D simulator are FracCADEâ (Schlumberger proprietary fracture design, prediction and treatment-monitoring software), Fracproâ sold by Pinnacle Technologies, Houston, Tex. USA, and MFraâ from Meyer and Associates, Inc., USA. Whether a fracture is being created and plugged in a single operation, or an existing fracture is being plugged, it is important that the fracture wall be covered top-to-bottom and end-to-end ("length and height") with filling slurry where the unwanted fluid flow is expected. It is not necessary to completely fill the width of the created fracture with material while pumping. It is necessary that enough material is pumped to a) at minimum, if the fracture is going to close after placement of the plugging material, create a full layer of the largest ("coarse") size material used across the entire length and height of the region of the fracture where flow is to be impeded, or to b) fill the fracture volume totally with material. When at least situation a) has been achieved, the fracture will be said to be filled with at least a monolayer of coarse particles. The, normal maximum concentration needed is three layers (between the faces of the fracture) of the coarse material. If the fracture is wider than this, but will close, three layers is all the filling material needed, provided that after the fracture closes the entire length and height of the fracture walls are covered. If the fracture is wider than this, and the fracture will not subsequently close, then either a) more filling material may be pumped to fill the fracture, or b) some other material may be used to fill the fracture, such as but not limited to the malleable material described above. More than three layers may be wasteful of particulate material, may allow for a greater opportunity of inadvertent undesirable voids in the particle pack, and may allow flowback of particulate material into the wellbore. Therefore, especially if the fracture volume filled-width is three times the largest particle size or greater, then a malleable bridging material may be added to reduce the flow of particles into the wellbore. This should be a material that does not increase the porosity of the pack on closure. Malleable polymeric or organic fibers are products that effectively accomplish this. Concentrations of up to about 9.6 g malleable bridging material per liter of carrier fluid may be used.

The carrier fluid may be any conventional fracturing fluid that will allow for material transport to entirely cover the fracture, will stay in the fracture, and will maintain the material in suspension while the fracture closes. Crosslinked guars or other polysaccharides may be used. Crosslinked polyacrylamide is preferred; crosslinked polyacrylamides with additional groups such as AMPS to impart even greater chemical and thermal stability are even more preferred. Such materials will concentrate in the fracture, will resist degradation, and will therefore provide additional fluid flow resistance in the pore volume not filled by particles. In higher permeability formations, where there would be concern about unwanted fluid flow into the fracture from the formation after the treatment, a hydroxyethylcellulose system or a viscoelastic surfactant fluid that will leak off into the matrix and impede flow in the matrix pores will help prevent flow into the fracture from the formation. These different types of viscosifiers may be used together to give resistance to both types of flow (within the fracture and into the fracture). Additionally, wall-building materials, such as fluid loss additives, may be used to further impede flow from the formation into the fracture. Wall-building materials such as starch, mica, and carbonates are well known.

Often it is necessary to plug only a portion of the fracture; this occurs in particular when the fracture is growing out of the desired region into a region in which a fracture through which fluid can flow is undesirable. This can be achieved using embodiments of the invention if the area to be plugged is at the top or at the bottom of the fracture. There are two techniques to achieve this; each may be used with either a cased/perforated completion or an open hole completion. In the first ("specific gravity") technique the bridging slurry is pumped before pumping of the main fracture slurry and has a specific gravity different from that of the main fracture slurry. If the filling slurry is heavier than the main fracture slurry, then the plugged portion of the fracture will be at the bottom of the fracture. If the filling slurry is lighter than the main fracture slurry, then the plugged portion of the fracture will be at the top of the fracture. The filling slurry will be inherently lighter or heavier than the proppant slurry simply because the particles are lighter or heavier than the proppant; the difference may be enhanced by also changing the specific gravity of the carrier fluid for the particles relative to the specific gravity of the carrier fluid for the proppant.

The second ("placement") technique is to run tubing into the wellbore to a point above or below the perforations. If the objective is to plug the bottom of the fracture, then the tubing is run in to a point below the perforations, and the bridging slurry is pumped down the tubing while the primary fracture treatment slurry is being pumped down the annulus between the tubing and the casing. This forces the filling slurry into the lower portion of the fracture. If the objective is to plug the top of the fracture, then the tubing is run into the wellbore to a point above the perforations. Then, when the filling slurry is pumped down the tubing while the primary fracture treatment slurry is being pumped down the annulus between the tubing and the casing, the filling slurry is forced into the upper portion of the fracture. The tubing may be moved during this operation to aid placement of the particles across the entire undesired portion of the fracture. Coiled tubing may be used in the placement technique.

Although the methods described here are most typically used for hydrocarbon production wells, they may also be used in storage wells and injection wells, and for wells for production of other fluids, such as water, carbon dioxide, or brine.

One skilled in the art would appreciate that other methods may also be used without departing from the scope of the invention. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

EXAMPLE

This example is for a two-particle system in which a fracture is created and plugged in a single operation. The first step was to determine the optimal size bridging material (the name given to the largest size, or "coarse", material used in the method) to be used. This will normally be the most common size used in conventional hydraulic fracturing for the geologic area and formation. In this example, sand of approximate diameter 0.203–0.432 mm was used because it was known, from experience and from calculations, that larger proppant sizes bridge when the formation under consideration is hydraulically fractured. To obtain a final pore volume of about 20%, a mixture of 49% of this 0.203–0.432 mm sand and 51% silica flour was used. Silica flour is a good choice for the smaller material, in this example "fine" material, because it is cheap and readily available. Silica dust may also be used, although respiration of fine crystalline silica should be avoided. This gives a predicted pore volume of 16%.

In the second step, using a common hydraulic fracture simulator such as FracCADEâ, and normal carrier fluid properties and pump rates, a schedule was designed that resulted in generation of a fracture the walls of which were covered with at least a single monolayer coverage over the entire portion of the fracture that was connected to the wellbore. Note that this coverage would be the same whether the fracture was open or closed. One monolayer of about 0.203–0.432 mm sand is about 0.73 kg/m$^2$ of fracture. A coverage of about 4.88 kg/m$^2$ was chosen for this example. The simulation was performed using the assumption, for the sake of the calculation, that only the single coarse 0.203–0.432 mm sand size range was used.

According to the FracCADEâ model prediction, pumping the mixture selected in step 1) using the pumping schedule selected in step 2) effectively gave total plugging of the created fracture when the pressure was released, the fracture was allowed to close on the created particle pack, and the excess fluid was forced out of the fracture. A particle pack was left in which the pores between the coarse particles were substantially filled with fine particles.

Input to the FracCADEâ program's simulation was typical of parameters for a well that could be treated with the compositions and methods of embodiments of the invention. The example uses parameters for a typical tight gas well that produces water, although alleviating this problem is only one of the uses of embodiments of the invention. The size of the larger particles (about 0.203–0.432 mm) was selected because it was known to be the optimal particle size for fracturing in the wells being modeled. The example uses an inexpensive uncrosslinked polymer.

TABLE 1

| | | |
|---|---|---|
| Depth to Base of Formation: | 3429 | m |
| Casing Diameter: | 22.23 | cm |
| Surface Temperature: | 26.7° | C. |
| Bottom Hole Static Temperature: | 143° | C. |
| Particle Type: | Sand | |
| Particle Size Range: | 0.203–0.432 | mm |
| Particle Specific Gravity: | 2.65 | |
| Particle Pack Porosity: | 15.0% | |
| Final Particle Concentration in Fracture: | 4.88 | kg/m$^2$ |
| Final Stress on Particles: | 47.48 | MPa |
| Final Permeability: | 0 | md |
| Shut-In Time: | 500 | min |
| Stage 1 (Pad) Pump Rate: | 795 | L/min |
| Stage 1 Carrier Fluid Type: | 4.79 | g/L guar in water |
| Stage 1 Carrier Fluid Volume | 1514 | L |
| Stage 1 Sand/Carrier Fluid Concentration: | 0 | |
| Stage 1 "Slurry" Volume: | 1514 | L |
| Stage 2 (Filling Slurry) Pump Rate: | 795 | L/min |
| Stage 2 Carrier Fluid Type: | 4.79 | g/L guar in water |
| Stage 2 Carrier Fluid Volume | 3785 | L |
| Stage 2 Sand/Carrier Fluid Concentration: | 0.72 | kg/L |
| Stage 3 Slurry Volume: | 4817 | L |
| Stage 3 (Flush) Pump Rate: | 795 | L/min |
| Stage 3 Carrier Fluid Type: | 1.12 | g/L guar in water |
| Stage 3 Carrier Fluid Volume | 40235 | L |
| Stage 3 Sand/Carrier Fluid Concentration: | 0 | |
| Stage 3 "Slurry" Volume: | 40235 | L |

Shown next is the job design proposed by the simulator in step 2) above. Table 2 shows the calculated parameters, and FIG. 1 shows the predicted plugged fracture location and size, and the calculated distribution of 0.203–0.432 mm plugging-sand in the fracture.

TABLE 2

| | | |
|---|---|---|
| Stage 1 (Pad) Guar Concentration | 4.74 | g/L |
| Stage 1 Mass Sand | 0 | |
| Stage 1 Pump Time | 1.9 | min |
| Stage 2 (Filling Slurry) Guar Concentration | 4.74 | g/L |
| Stage 2 Mass Sand | 2722 | kg |
| Stage 2 Pump Time | 6.1 | min |
| Stage 3 (Flush) Guar Concentration | 1.12 | g/L |
| Stage 3 Mass Sand | 0 | |
| Stage 3 Pump Time | 50.6 | min |

In FIG. 1, the stress range shown (6,000 psi to 12,000 psi) is equal to about 41.37 MPa to about 82.74 MPa; the "ACL"("After Closure") width range shown (−0.10 inch to +0.10 inch) is equal to about 0.254 cm to about +0.254 cm; the fracture half-length shown (0 to 400 feet) is equal to 0 to about 122 m. The concentration ranges of filling material shown (from 0.0 to 0.2 lb/ft$^2$ to >1.3 lb/ft$^2$) are equal to from 0 to about 0.98 kg/m$^2$ to>about 9.76 kg/m$^2$. The concentration ranges decrease from the outside of that part of the figure to the inside, with the highest three ranges appearing in two locations.

What is claimed is:

1. A method of treating an existing fracture in a subterranean formation penetrated by a wellbore to reduce the fluid flow capacity of the fracture comprising:

a. providing a particulate material comprising a quantity of coarse particles having diameters from about 0.20 mm to about 2.35 mm, and a quantity of smaller particles selected from the group consisting of medium particles, fine particles, and mixtures thereof;

b. providing a carrier fluid capable of suspending said particulate material;

c. mixing said particulate material and said carrier fluid to form a slurry; and d. pumping said slurry through said wellbore into said existing fracture, whereby a particulate pack comprising at least a monolayer of the coarse particles is formed in at least a portion of said existing fracture.

2. The method of claim 1 wherein the coarse particles have diameters from about 0.20 mm to about 0.43 mm.

3. The method of claim 1 wherein the medium particles have diameters from about 0.10 mm to about 0.20 mm.

4. The method of claim 1 wherein the fine particles have diameters less than about 0.10 mm.

5. The method of claim 1 wherein the coarse particles have from about 5 times to about 12 times the mean diameter of the medium particles.

6. The method of claim 5 wherein the coarse particles have about 10 times the mean diameter of the medium particles.

7. The method of claim 1 wherein the medium particles have from about 5 times to about 12 times the mean diameter of the fine particles.

8. The method of claim 7 wherein the medium particles have about 10 times the mean diameter of the fine particles.

9. The method of claim 1 further wherein the fracture closes on the placed particulate material after the slurry is pumped into the fracture.

10. The method of claim 1 wherein the particulate material is inert.

11. The method of claim 1 wherein the carrier fluid is viscosified.

12. The method of claim 1 wherein the slurry further comprises a malleable material.

13. The method of claim 12 wherein the malleable material comprises fibers.

14. The method of claim 1 wherein the ratio of the amount of coarse particles to the amount of smaller particles is close to that which gives maximum compaction.

15. The method of claim 1 wherein the fracture filled with the particulate pack has a maximum void volume of 17%.

16. The method of claim 1 wherein the slurry further comprises a component that leaks off into the formation and impedes fluid flow into the fracture.

17. The method of claim 1 wherein the slurry further comprises a wall-building material.

18. In a hydraulic fracturing process comprising injecting a slurry of proppant and carrier fluid into a subterranean formation penetrated by a wellbore to form a substantially vertical fracture wherein the fracture may grow to a height greater than desired, a method of plugging the undesired portion of the fracture comprising first adding a slurry of an amount of a particulate material comprising a quantity of coarse particles, and a quantity of smaller particles selected from the group consisting of medium particles, fine particles, and mixtures thereof, and then injecting a slurry of proppant, wherein the slurry of particulate material has a specific gravity different from the specific gravity of the slurry of proppant, the amount of particulate material effective to fill the portion of the fracture beyond the desired height with a particulate pack having a void volume of less than about 17%, whereby said portion of the fracture beyond the desired height does not grow further when the slurry of proppant is injected.

19. The method of claim 18 wherein the slurry of particulate material has a lower specific gravity than the slurry of proppant.

20. The method of claim 18 wherein the slurry of particulate material has a higher specific gravity than the slurry of proppant.

21. In a hydraulic fracturing process comprising injecting a slurry of proppant and carrier fluid into a subterranean formation penetrated by a wellbore to form a fracture between a desired limit proximate to the wellhead and a desired limit distal to the wellhead, wherein the fracture is growing beyond one of the desired limits, a method of plugging the undesired portion of the fracture comprising injecting an amount of a particulate material comprising a quantity of coarse particles, and a quantity of smaller particles selected from the group consisting of medium particles, fine particles, and mixtures thereof, through tubing inserted into the wellbore to a depth not between the desired limits, the proppant slurry being injected through the annulus between the tubing and the wellbore to a region between the desired limits, the amount of particulate material effective to fill the portion of the fracture not between the desired limits with a particulate pack comprising at least a monolayer of the coarse particles.

22. The method of claim 21 wherein the fracture is growing between the proximate desired limit and the wellhead and the tubing is inserted between the proximate desired limit and the wellhead.

23. The method of claim 21 wherein the fracture is growing between the distal desired limit and the wellhead and the tubing is inserted between the distal desired limit and the wellhead.

24. A method of fracturing a subterranean formation penetrated by a wellbore comprising:

a. injecting a slurry of proppant, then b. providing a particulate material comprising a quantity of coarse particles, and a quantity of smaller particles selected from the group consisting of medium particles, fine particles, and mixtures thereof; and c. providing a carrier fluid capable of suspending said particulate material; and d. mixing said particulate material and said carrier fluid to form a slurry; and then e. pumping said slurry through said wellbore into said fracture, whereby a particulate pack comprising at least a monolayer of the coarse particles is formed in at least a portion of said fracture.

25. A method of fracturing a subterranean formation penetrated by a wellbore comprising:

a. providing a particulate material comprising a quantity of coarse particles, and a quantity of smaller particles selected from the group consisting of medium particles, fine particles, and mixtures thereof; and b. providing a carrier fluid capable of suspending said particulate material; and c. mixing said particulate material and said carrier fluid to form a slurry; and then d. pumping said slurry through said wellbore into said fracture, thereby forming a fracture containing a particulate pack comprising at least a monolayer of the coarse particles and having a void volume of less than about 17% in at least a portion of said fracture.

* * * * *